United States Patent [19]

Shibata et al.

[11] Patent Number: 4,985,284

[45] Date of Patent: Jan. 15, 1991

[54] COATING METHOD

[75] Inventors: Norio Shibata; Sato Tsunehiko, both of Kanagawa, Japan

[73] Assignee: Fuji Photo Film Co., Ltd., Kanagawa, Japan

[21] Appl. No.: 390,015

[22] Filed: Aug. 7, 1989

[30] Foreign Application Priority Data

Aug. 19, 1988 [JP] Japan ..... 63-204806

[51] Int. Cl.[5] ..... B05D 1/28

[52] U.S. Cl. ..... 427/428; 427/128; 427/434.2

[58] Field of Search ..... 427/128, 428, 434.2

*Primary Examiner*—Bernard Pianalto

*Attorney, Agent, or Firm*—Sughrue, Mion, Zinn, Macpeak & Seas

[57] ABSTRACT

A coating method and apparatus employing an extrusion-type coating head in which the probability of damaging the surface of the layer being formed on a support is remarkably decreased. Coating solution, such as a magnetic solution for forming a magnetic recording tape or the like, is supplied by a pump through a pipe line and thence a filtering element to the extrusion-type coating head, which applies the coating solution onto a support being run directly or through a coating roll. The filtering element, which is disposed at or near the coating solution supplying inlet of the extrusion-type coating head, has openings whose diameter is smaller than a coating clearance between a doctor edge of the extrusion-type coating head and the support or coating roll.

4 Claims, 3 Drawing Sheets

COATING METHOD

BACKGROUND OF THE INVENTION

The present invention relates to a coating method and apparatus in which a desired coating solution is supplied to an extrusion-type coating head and the coating head applies the coating solution to a running support. More particularly, the invention relates to a coating method and apparatus suitable for the manufacture of a magnetic recording medium in which a coating solution such as a magnetic coating solution is applied to the surface of a belt of paper or an elongated web (support) of soft synthetic resin or the like which is being run.

Heretofore, a magnetic recording medium such as a magnetic tape or a photographing film has been formed by applying a coating solution, selected according to the purpose of use, to the surface of a support, drying the support thus treated, and cutting the support to a desired width and length. The term "support" as used herein is intended to mean a belt-shaped material made of a macromolecular compound such as polyethylene terepthalate, cellulose acetate, polyimide or polyamide, paper, copper or metal foil. The "coating solution" includes magnetic material dispersion solutions. photosensitive material coating solutions, heat-sensitive material coating solutions, and macromolecular molten solutions.

A coating apparatus using such a coating solution may use an extrusion-type coating head as disclosed, for instance, in Japanese patent application (OPI) No. 84771/1982.

The structure of an extrusion-type coating head and a coating method using the coating head will be discussed with references to FIGS. 6 through S.

A coating solution A is supplied through a coating solution supplying device 3 such as a pipe into a pocket 2 formed in an extruder 1. The pocket 2 is substantially circular in cross section; that is, it is a solution pool whose length is substantially equal to the width of the extruder 1. The effective length of the pocket 2 is, in general, equal to or slightly longer than the coating width.

A slot 4 is formed in the extruder 1 in such a manner that it is communicated with the pocket 3, thus providing a flow path for the coating solution A. The length of the slot 4 is substantially equal to that of the pocket 2.

The pocket 2 is filled with the coating solution A applied through the coating solution supplying device 3 under pressure, as a result of which the coating solution A is caused to flow from the pocket 2 towards the outlet with a uniform liquid pressure distribution.

The extruder 1 has a doctor edge 5 located downstream of a support 7 to which the coating solution A is applied, and a back edge 6 located upstream of the support 7.

The levels of the end faces of the edges 5 and 6 are established depending on the configuration, curvature, etc. of the support 7, for instance, as shown in FIGS. 6 and 7.

The extrusion-type coating heads thus constructed are arranged according to the actual use. For example. as shown in FIG. 6, a coating solution A is applied to a support 7 which is run while being supported by a backup roller 11, as shown in FIG. 7, a coating solution A is applied to a support 7 which is not backed up, and, as shown in FIG. 8, a coating solution is applied to a support with the aid of rollers 12 and 13. In each case, the coating solution A is supplied to the pocket 2 through a solution delivering device such as a pump and a coating solution supplying device such as a pipe.

However, if dust or the like is mixed in the coating solution A. it may scratch the support 7 or make the coated surface of the support uneven. In such instances, the resultant product may be unacceptable.

In order to overcome this difficulty, i.e., to remove the dust or reduce the amount of dust, heretofore a filter has been provided in the path of the coating solution supplying device.

However, relatively large particles can still pass through the conventional filter, or large particles formed in the coating solution supplying line between the filter and the pocket 2, such as deposits stuck to the inner walls of the pipes, can be delivered into the pocket 2 together with the coating solution A.

These large particles can be trapped between the support 7 and the end face of the extruder 1, thus forming longitudinal stripes on the coated surface of the support 7.

In the case where a thin film layer is formed on the support by applying a coating solution A thereto, the gap between the support and the end face of the extruder is so small that the probability of trapping large particles therebetween, which results in the formation of longitudinal stripes on the coated surface of the support, is increased.

SUMMARY OF THE INVENTION

Accordingly, an object of the invention is to eliminate the above-described difficulties accompanying a conventional coating method and apparatus using an extrusion-type coating head. More specifically, an object of the invention is to provide a coating method and apparatus using an extrusion-type coating head in which the probability of damaging the surface of the layer formed on the support by coating is decreased.

The foregoing and other objects of the invention have been achieved by the provision of a coating method and apparatus in which a desired coating solution is supplied to an extrusion-type coating head by coating solution supplying means, and the coating solution is applied by the extrusion-type coating head directly or through a coating roll to a support being run, in which, according to the invention, at one end of the coating solution supplying means a filtering element is provided at or near the coating solution supplying inlet of the extrusion-type coating head, the filtering elements having openings whose diameter is smaller than the coating clearance between the doctor edge of the extrusion-type coating head and the support or the coating roll, and the coating solution is supplied to the extrusion-type coating head after being filtered by the filtering element.

In the coating method and apparatus of the invention the diameter of the openings of the meshes or the like of the filtering element is smaller than the gap between the doctor edge of the extrusion-type coating head and the support. Therefore, large particles which otherwise would be caught in the gap are not supplied to the coating head.

The filtering element is positioned immediately before the coating head; that is, no long coating solution supplying path exists between the filtering element and the coating head. This eliminates the difficulty of large particles formed by coagulation of the coating solution in the path being mixed into the coating solution.

Thus, the coating method and apparatus of the invention is free from the difficulty that, in coating the support with the coating solution, dust or large particles form longitudinal stripes on the layer formed on the support. Accordingly, the resultant product is higher in reliability.

DESCRIPTION OF THE PREFERRED EMBODIMENTS

Preferred embodiments of the invention will be described with reference to the accompanying drawings.

Figure 1:
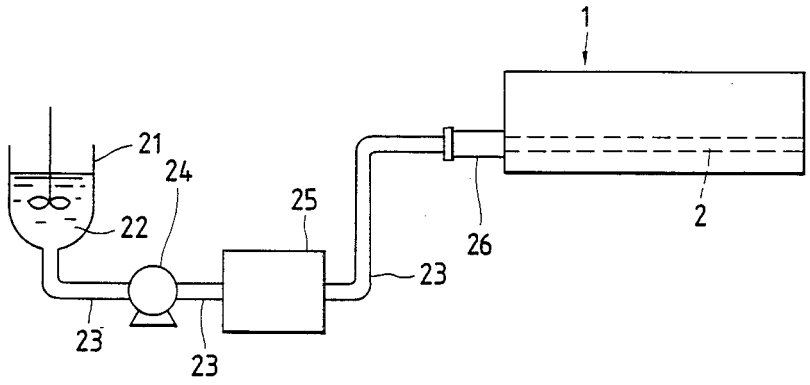
FIG. 1 is an explanatory diagram for a description of the operation of a coating solution supplying system for practicing a coating method and apparatus according to this invention.
Figure 2:
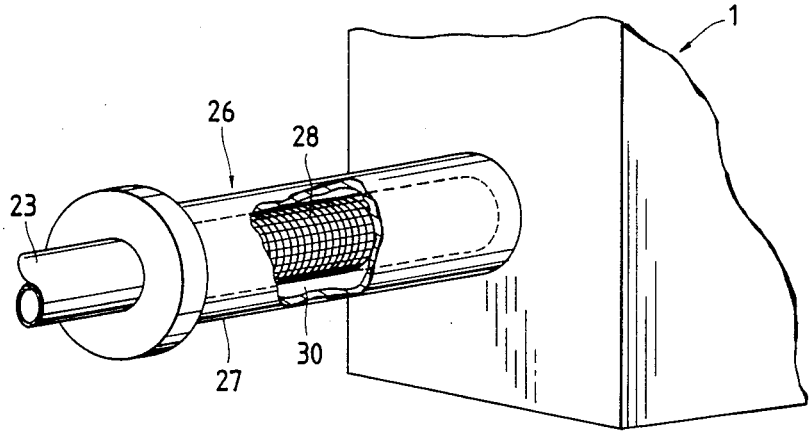
FIG. 2 is a perspective view showing the structure of a filter coupled to a coating head in the coating solution supplying system in FIG. 1.
Figure 3:
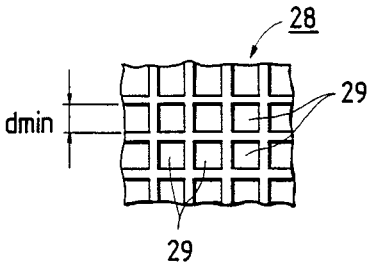
FIG. 3 is an enlarged view of a part of a filtering element.
Figure 4:
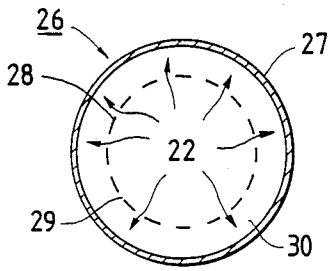
FIG. 4 is a sectional vieW for a description of the operation of the filter shown in FIG. 2.
Figure 5:
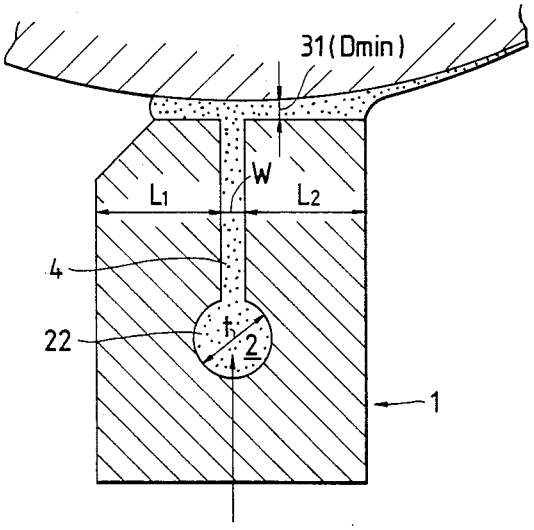
FIG. 5 is a sectional view showing a coating operation with an extrusion-type coating head shown in FIG. 1.

FIG. 1 is an explanatory diagram showing a coating solution supplying system embodying a coating method and apparatus according to the invention. FIG. 2 is a perspective view showing essential components for a description of the construction of a filter and the installation of a coating head. FIG. 3 is an enlarged view showing a part of a mesh forming the filter. FIG. 4 is a sectional view for a description of the filtration of the filter. FIG. 5 is a sectional view for a description of a coating operation according to the invention.

Figure 6:
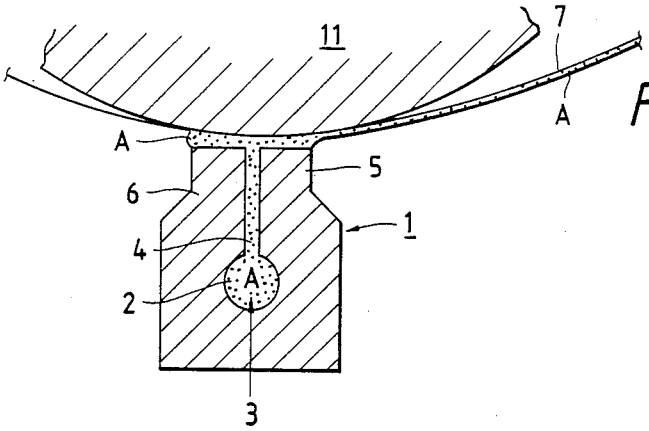
FIGS. 6, 7 and 8 are sectional vieWs for a description of the structures of examples of an extrusion-type coating head and coating methods with such coating heads.
Figure 7:
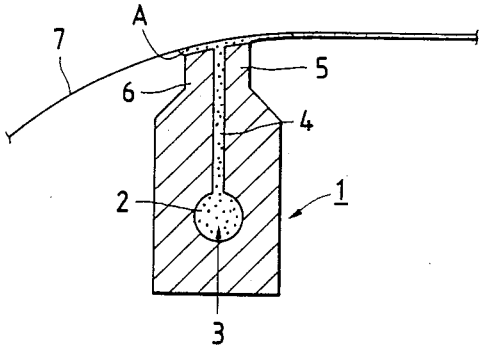
Figure 8:
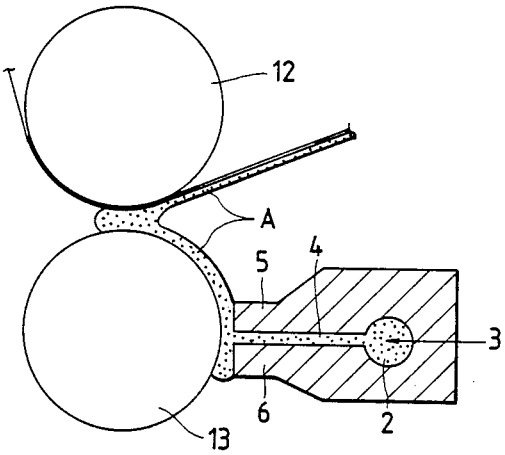

In this embodiment, a coating operation is carried out with a conventional extrusion-type coating head as described above with reference to FIGS. 6 through 8. In FIGS. 1 through 5, parts corresponding functionally to those which have been described with reference to FIGS. 6 through 8 are designated by the same reference numerals or characters.

First, the coating solution supplying system will be described with reference to FIG. 1.

A coating solution 22 such as a magnetic solution is stored in a coating solution tank 21. The coating solution 22 is supplied, under a predetermined pressure, to a first filter 25 by a solution supplying pump 24 which is provided in the path of the coating solution supplying device, namely, a pipe line 23.

The filter 25 is provided to filter out large particles in the coating solution 22, thereby to make the latter uniform in quality. The filtered coating solution 22 is applied through the pipe line 23 to a second filter 26.

The second filter 26, as shown in FIGS. 1 and 2, is disposed at or near the coating solution supplying inlet of the extrusion-type coating head 1 so that the coating solution 22 is filtered by the filter 26 is directly supplied into the coating head 1 without passing through a pipe line. In general, the coating solution supplying system of the invention should be located within one meter from the coating head 1.

The internal structure of the filter 26 is as shown in FIGS. 2 and 4. That is, the filter 26 is composed of a cylinder 27 and a filtering element 28 in the form of a net.

The filtering element 28 is disposed in the cylinder 27 with a predetermined gap therebetween.

The filtering element 28 is circular in section, and one end thereof is connected to the above-described pipe line 23 to receive the coating solution 22. At the other end of the filtering element 28, the mesh part has a semi-spherical shape so that the filtering area is large enough to allow the coating solution 22 to flow smoothly.

Upon operating the solution supplying pump 24, the preliminarily filtered coating solution 22 is forced through the pipe line and the injecting section of the filter into the filtering element 28 under a predetermined pressure.

As a result, the coating solution 22 is caused to flow through the meshes (holes) 29 of the filtering element 28 into the space 30 between the cylinder 27 and the filtering element 28. The space 30 is communicated with a pocket 1 in the coating head 1 so that the coating solution filtered secondarily by the filtering element 28 is supplied into the pocket under a certain pressure.

The meshes (openings) of the filtering element 28 are sized to pass the coating solution but to block the passage of large particles in the coating solution, that is, to filter the coating solution. The size of the meshes of the filtering element 28 is determined to meet the following condition:

$$D_{min} > D_{max}$$

where $D_{min}$ is the width of the gap 31 between the end face of the coating solution and the support 7 as shown in FIG. 5, and $D_{min}$ is the diameter of each mesh. Accordingly, if large particles ar contained in the coating solution injected into the filtering element 28, those larger in diameter than $D_{min}$ are trapped. The coating solution thus filtered is supplied into the pocket 2. Therefore, the coating solution 22 flowing s out of the pocket 2 through the slit 4 contains no particles larger than the gap width $D_{min}$. Thus, in applying the coating solution 22 to the support 7, no large particles can be caught in the gap, and accordingly no longitudinal stripes formed in the surface of the film layer on the support.

In the above-described embodiment, the diameter $D_{min}$ of each mesh 29 is smaller than the gap width $D_{min}$; however, in the case where the width w of the slit 4 is smaller than the gap width $D_{min}$, the following conditions may be used:

$$w > d_{min}$$

That is, the diameter $d_{min}$ of the meshes (openings) 29 is set to smaller than the minimum width of the coating solution path from the pocket 2 to the support 7.

With the diameter $d_{min}$ of the meshes of the filtering element determined as described above, large particles or foreign matter which could produce longitudinal stripes on the surface of the layer formed on the support are filtered out of the coating solution, and hence the resultant product is satisfactory in quality.

The filtering element 28 may be a metal net having uniform meshes, or it may be made of uniform metal particles or a uniformly sintered material having openings (pores) substantially uniform and of a known configuration and area to allow filtration on the surface thereof.

It is preferable that the filtering element 28 be of the in-line type so as to not detain the coating solution 22 in the pipe line 23. However, the configuration of the filtering element 28 is not limited thereto or thereby: that is, the filtering element 28 may be freely shaped if it will not detain the coating solution.

As described above, in the inventive coating method and apparatus, using an extrusion-type coating head, a filtering element having openings whose diameter is smaller than the minimum gap width of the coating solution path formed between the coating head and the support is arranged near the coating head, for instance, immediately before the coating head, so that the coating solution passed through the openings is supplied to the coating head to coat the support. Therefore, no particles larger than the coating solution path or the gap width will be contained in the coating solution supplied to the coating head. Accordingly, the coating method and apparatus of the invention is free from the difficulty of large particles being caught in the gap and scratching the surface of the layer formed on the support.

Furthermore, in the coating method and apparatus of the invention, unlike the conventional coating method and apparatus in which the filtered coating solution is supplied through a long coating solution supplying pipe to the coating head, the finally filtered coating solution is directly supplied into the coating head. Therefore, particles stuck to the inner wall of the pipe will not newly enter the coating solution; that is, the effect of filtration is greatly improved.

As conductive to a full understanding of the effects of the invention, an example thereof will be described.

In this example, the composition of the coating solution was as indicated in the following Table 1:

TABLE 1

| | |
|---|---|
| ? -$Fe_2O_3$, (acicular particles 0.5 μm in average diameter in direction of major axis, coercive force = 350 Oe. S= = =29 $m^2/g$) | 100 parts by weight |
| polyurethane resin | 10 parts by weight |
| epoxy resin | 15 parts by weight |
| polyisocyanate | 9.5 parts by weight |
| carbon black | 2 parts by weight |
| mysistic acid | 1.5 parts by weight |
| cyclohexanone | 325 parts by weight |

The coating solution thus prepared was disperse mill for 7.5 hours, as a result of which its viscosity was set to 85 cp.

The support 7 was made of PET, having a thickness of 15 μm and a width of 350 mm. It was conveyed at 200 m/min.

A coating head 1 as shown in FIG. 5 was used. The dimensions of the coating head were as follows: clearance $D_{min}$=0.03 mm, slot gap w=0.6 mm, pocket diameter t=25 mm, $L_1$=2.5 mm, and $L_2$=5.0 mm. The coating solution 2 was supplied in the manner described with reference to FIG. 1. A gear pump was used as the pump 24, and a type CP-5 filter manufactured by Chisso Co., Ltd., of Japan, which can remove 90% of particles down to 40 μm in diameter. Was employed as the first filter 25.

A filter the same in construction to the above-described second filter 26 was used. The net of the filtering element 28 was made of SUS 304 type wire mesh. More specifically, three filters different in the diameter $d_{min}$ of meshes or openings 29 as shown in the following Table 2 were used. The filters were substantially in the form of a test tube 7.5 mm in diameter and 95 mm in length. Each filtering element was positioned within 100 mm from the coating head 1.

TABLE 2

| Filter No. | Mesh size |
|---|---|
| 1 | 0.040 mm |
| 2 | 0.025 mm |
| 3 | 0.015 mm |

The amount of coating solution applied to the support 22 was 15 cc/$m^2$.

Under the above-described conditions, the coating solution was applied to a 2,000 m length of the support with the mesh size changed. The results of the coating operations are indicated in the following Table 3.

TABLE 3

| Presence or absence of filtering element 28 in filter 26, and mesh size | Number of scratches formed |
|---|---|
| No filtering element 28 | 11 |
| Filter No. 1 | 3 |
| Filter No. 2 | 0 |
| Filter No. 3 | 0 |

As is apparent from Table 3. making the diameter $d_{min}$ of the pores of the filtering element 28 smaller than the gap width $D_{min}$ and positioning the filter 27 immediately before the coating head can greatly reduce the possibility of forming s scratches on the coated surface and prevents the coated surface from being damaged during coating.

What is claimed is:

1. A coating method in which a desired coating solution is supplied to an extrusion-type coating head by coating solution supplying means, and the coating solution is applied with the extrusion-type coating head directly or through a coating roll to a support being run, wherein the improvement comprises:

providing at one end of said coating solution supplying means a filtering element disposed at or near a coating solution supplying inlet of said extrusion-type coating head, said filtering element having openings whose diameter is smaller than a coating clearance between a doctor edge of said extrusion-type coating head and said support or said coating roller, and supplying said coating solution to said extrusion-type coating head after being filtered by said filtering element.

2. The coating method as claimed in claim 1, wherein said filtering element is located within 1 meter of said extrusion-type type coating head.

3. The coating method as claimed in claim 1, wherein said diameter of said openings of said filtering element is smaller than a slit width of said extrusion-type coating head.

4. The coating method as claimed in claim 1, further comprising the step of preliminarily filtering said coating solution at a point upstream of said filtering element.

* * * * *